United States Patent [19]

Washino

[11] 4,082,119

[45] Apr. 4, 1978

[54] METHOD OF AND DEVICE FOR CONTROLLING A WEAVING LOOM

[75] Inventor: Kozo Washino, Hachioji, Japan

[73] Assignee: Nissan Motor Company, Limited, Japan

[21] Appl. No.: 743,954

[22] Filed: Nov. 22, 1976

[30] Foreign Application Priority Data

Nov. 25, 1975 Japan ..... 50-140266

[51] Int. Cl.[2] ..... D03D 51/34

[52] U.S. Cl. ..... 139/370.2

[58] Field of Search ..... 139/336, 341, 370.1, 139/370.2; 66/163; 226/11, 100; 242/37 R; 340/259

[56] References Cited

U.S. PATENT DOCUMENTS

| | | | |
|---|---|---|---|
| 3,495,633 | 2/1970 | Sakamoto et al. | 139/370.2 |
| 3,802,468 | 4/1974 | Meyer et al. | 139/370.2 |
| 3,863,241 | 1/1975 | Kamiyamaguchi et al. | 340/259 |
| 4,023,599 | 5/1977 | Zeleny | 139/370.2 |

FOREIGN PATENT DOCUMENTS

| | | | |
|---|---|---|---|
| 34,791 | 5/1966 | Japan | 139/370.2 |

*Primary Examiner*—Henry S. Jaudon

*Attorney, Agent, or Firm*—Robert E. Burns; Emmanuel J. Lobato; Bruce L. Adams

[57] ABSTRACT

Failure in a weft inserting motion of a weaving loom is detected if a weft yarn, which is shot into a shed of warp yarns, separates from electrodes, a predetermined number of times, within one picking motion to stop the weaving loom.

13 Claims, 19 Drawing Figures

1
0

1
0

1
0

1
0

1
0

1
0

1
0

1
0

I
O

I
O

I
O

I
O
L

I
O

I
O

METHOD OF AND DEVICE FOR CONTROLLING A WEAVING LOOM

BACKGROUND OF THE INVENTION

This invention relates to a method of and a device for controlling a weft inserting motion of a weaving loom for stopping the loom in response to failure in the weft inserting motion.

Several methods and devices have been proposed for stopping a weaving loom in response to failure in a weft inserting motion. According to one of the conventional methods and devices, a failure in a weft inserting motion is detected by checking whether or not an electrical current flows through two electrodes by means of a weft yarn contacting the two electrodes.

However, a defect can be pointed out in the above described conventional methods and devices. That is, when the weft yarn, which is properly shot into a shed of warp yarns, separates from one of the two electrodes even for an instant during a detecting time period, a failure in the weft inserting motion is undesirably detected regardless of a proper picking.

SUMMARY OF THE INVENTION

It is therefore a primary object of the present invention to provide an improved method of removing the aforementioned defect of the prior art, according to which method failure in a weft inserting motion is detected only if the number of connections of the weft yarn with the two electrodes reaches a predetermined number within one picking motion.

Another object of the present invention is to provide an improved device for removing aforementioned defect of the prior art, which device detects failure in the weft inserting motion only if the number of connections of the weft yarn with the two electrodes reaches a predetermined number within one picking motion.

BRIEF DESCRIPTION OF THE DRAWINGS

These and other objects, features and many of the attendant advantages of this invention will be appreciated more readily as the invention becomes better understood by the following detailed description, when considered in connection with the accompanying drawings, wherein like parts in each of the several figures are identified by the same reference characters, and wherein.

Figure 1:
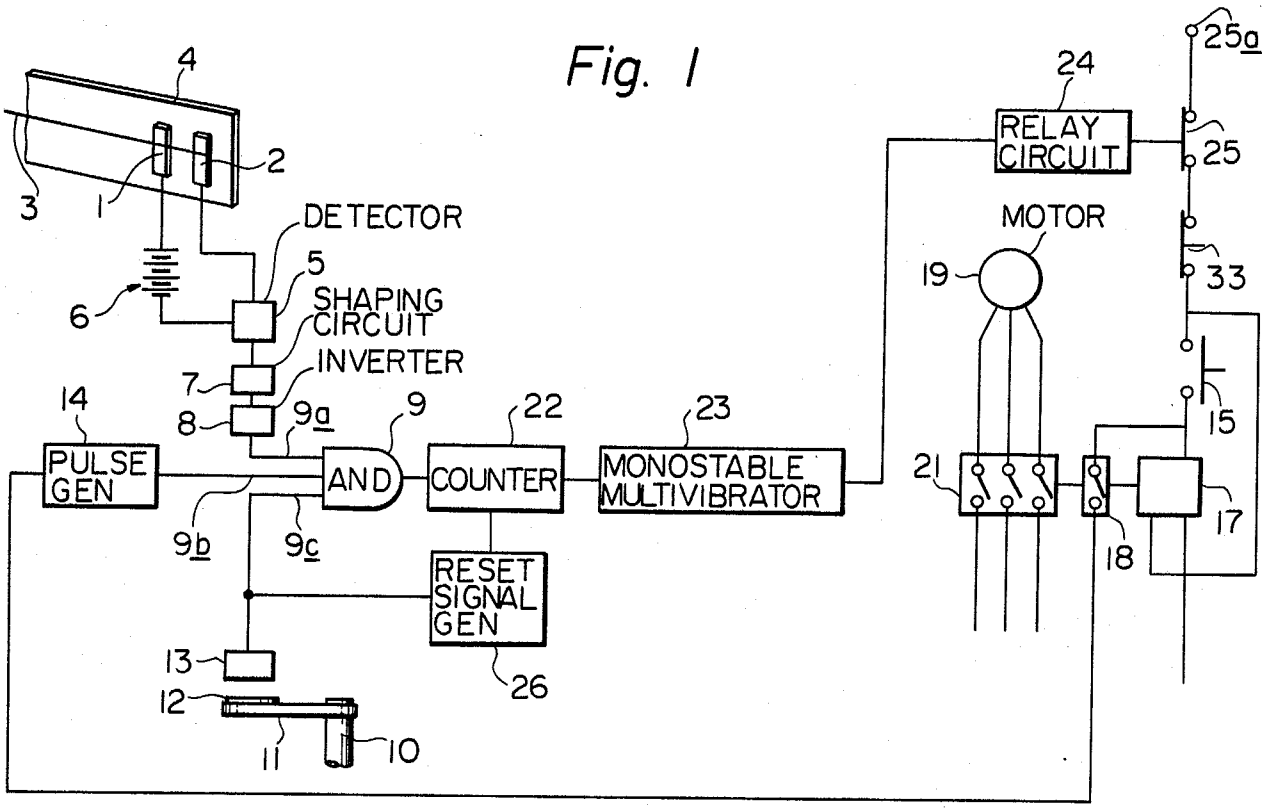
FIG. 1 is a block diagram illustrating a first embodiment of the present invention.

Reference is now made to FIG. 1, which illustrates a first embodiment of the present invention in a block diagram.

DESCRIPTION OF THE PREFERRED EMBODIMENTS

Two electrodes 1 and 2 are provided on a reed 4 at the opposite side with respect to a suitable yarn shooting means (not shown), wherein it is preferable that the electrodes 1 and 2 are sufficiently spaced in order to avoid an undesirable electrical connection due to shooting-water although a weft yarn 3 does not touch the electrodes. As shown, the electrode 1 is connected at one end thereof to one end of a d.c. power source 6, and the other end of the d.c. power source 6 is connected to a detector 5. The electrode 2 is connected at one end thereof to the detector 5. The weft yarn 3 serves, in picking, to electrically contact the electrodes 1 and 2, thereby to allow a d.c. current to flow a series circuit consisting of the electrodes 1 and 2, the detector 5, and the d.c. power source 6. The signal from the detector 5, which represents whether or not the weft yarn 3 contacts the electrodes 1 and 2, is fed to a wave form shaping circuit 7. A shaped signal from the circuit 7 is then fed to an AND gate 9 through an inverter 8 and an input terminal 9*a*.

An arm 11 is fixedly attached to a rotatable axis 10 which rotates in synchronism with motion of a weaving loom (not shown). As shown, a piece of iron 12 such as a permanent magnet is fixedly attached to the arm 11. In the vicinity of the locus of the movement of the piece of iron 12, a suitable switching means including a coil is provided to generate a signal indicative of a logic "1" when the piece of iron 12 comes in the neighborhood of the switching means 13. The signal from the switching means 13 represents a time period of a weft yarn inserting motion and is fed to the AND gate 9 through an input terminal 9*c*. The AND gate 9 is connected through an input terminal 9*b* to a pulse generator 14 which always generates a train of pulses at a predetermined time intervals after a weaving loom starting switch 15 is switched on. Once the starting switch 15 is switched on, a hook-type switch 17 is closed and retains its condition as long as left alone to close an interlocked contact 18, thereby to supply the pulse generator 14 with an electrical energy from a power source (not shown) connected to a terminal 25*a*. On the other hand, the hook-type switch 17 closes a plurality of interlocked contacts 21 to energize a weaving loom driving motor 19.

The pulses from the pulse generator 14 is fed to a counter 22 through the AND gate 9 only when the three inputs each denotes a logic "1," as is well known in the art. The counter 22 generates a signal when the number of the pulses from the pulse generator 14 reaches a predetermined number within one detecting time period, allowing a monostable multivibrator 23 to generate a control signal. The control signal thus produced is then fed to a relay circuit 24 to allow the same to open a switch 25 connected in series with a manual stop switch 33. This means that the driving motor 19 is deenergized to stop the loom. In the above, it is preferable to determine the one detecting time period such that it corresponds to a time period indicated by the signal from the switching means 13. Whilst, if the number of the pulses from the pulse generator 14 does not reach the predetermined number within one detecting time period, the counter 22 does not generate any signal therefrom. In the above two cases, the number of the pulses stored in the counter 22 is cleared by a reset signal generator 26 at the end of the detecting time period.

In the above, the pulse repetition rate of the pulse generator 14 and the predetermined number of the counter 22 should be changed in accordance with a kind of a weft yarn, for example.

Figures 2A, 2B, 2C, 2D, 2E, 2F, 2G, 2H, 2I, 2J:
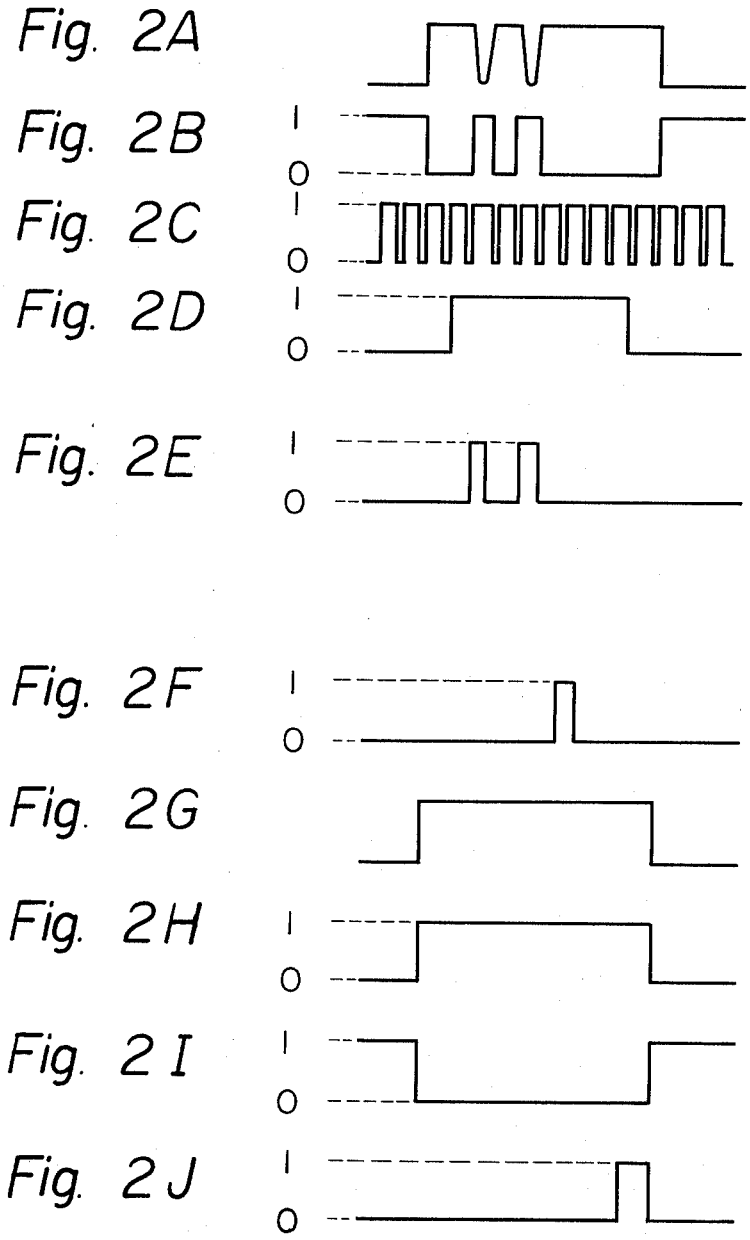
FIGS. 2A–2J show wave forms of various signals appearing at various parts of the block diagram of FIG. 1.

In the following, the operation of the first preferred embodiment of FIG. 1 will be described in connection with FIGS. 2A—2J. When the starting switch 15 is switched on, the motor 19 is energized to start the loom (not shown) and the pulse generator 14 begins to generate a train of pulses at a predetermined repetition rate. If the weft yarn 3 contacts the electrodes 1 and 2 during all the detecting time period, the signal from the detector 5 has a wave form as shown in FIG. 2G. In this case, the signals from the shaping circuitry 7 and the inventer 8 have wave forms as shown in FIGS. H and I, respectively. On the other hand, the wave form of the signal from the generator 14 is denoted in FIG. 2*c*, and the wave form of the signal from the switching means 13 is denoted in FIG. 2D. In the above case, that is, when the weft yarn 3 contacts the electrodes 1 and 2 during all the detecting time period, the AND gate 9 does not generate any output in that the signal from the inverter 8 indicates a logic "0."

Whilst, if the weft yarn 3 separates two times, for example, while the signal from the switching means 13 indicates a logic "1," the signal from the detector 5 has a wave form as shown in FIG. 2A. The signal from the detector 5 is then fed to the shaping circuitry 7 in which the signal is shaped. Therefore, it is understood that the output of the AND gate has a wave form as shown in FIG. 2E. This means that the counter 22 counts two pulses for the detecting time period.

On the other hand, if the weft yarn 3 does not contact the electrodes 1 and 2 while the signal from the switching means 13 indicates a logic "1," as shown in FIG. 2D, the signal from the detector 5 does not indicate a logic "1." Therefore, the AND gate receives a logic "1" for the detecting time period at the input terminal 9*a*. This means that the counter 22 receives 8 pulses from the pulse generator 14 through the AND gate 9. In the above, even if considering a phase shift between the inputs to the AND gate, the counter 22 counts at least 7 pulses during the detecting time period. As a result, when the predetermined number of the counter 22 is set to 7, the counter 22 generates a signal as shown in FIG. 2F, which signal triggers the monostable multivibrator 23, thus stopping the weaving loom as already referred to.

In the above three cases, the reset signal generator 26 generates the reset signal in response to a trailing edge of the signal from the switching means 13, as shown in FIG. 2J. The reset signal is fed to the counter 22 to clear the same. Thus, the loom continues to operate.

In the foregoing, the inverter 8 cam be omitted wherein the counter 22 generates its output when the number of the pulses from the pulse generator 14 is less than a predetermined number.

Figure 3:
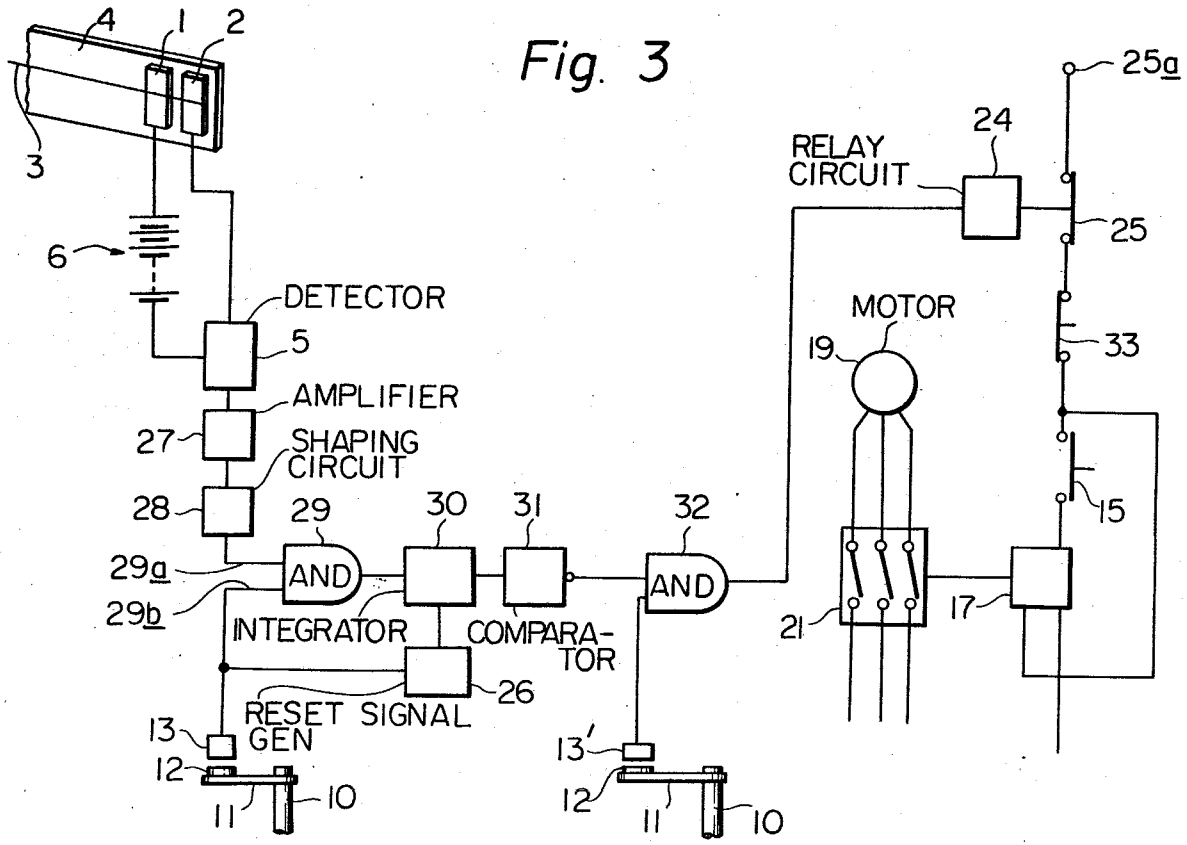
FIG. 3 is a block diagram illustrating a second embodiment of the present invention.
Figures 4A, 4B, 4C, 4D, 4E, 4F, 4G:
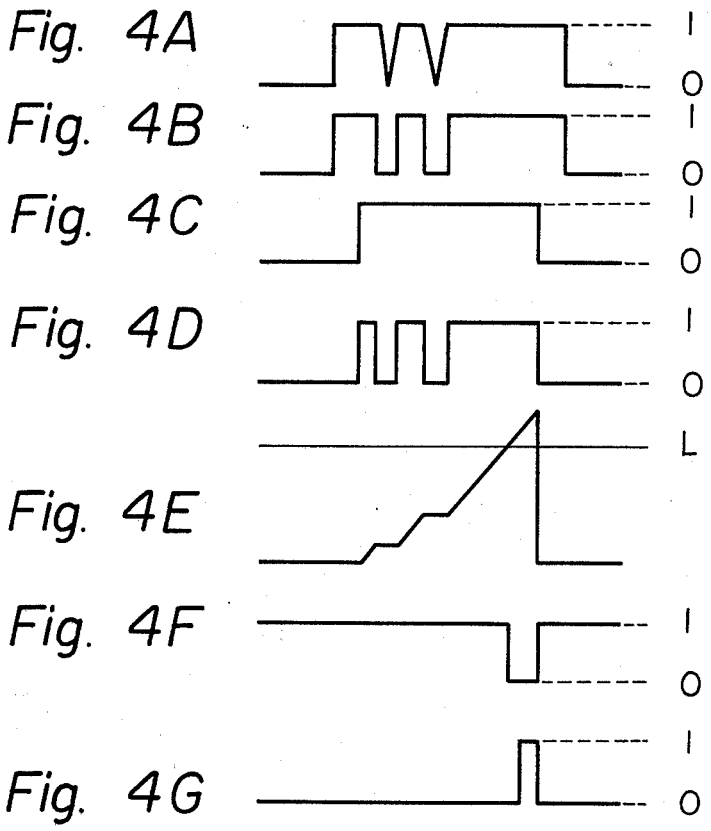
FIGS. 4A–4G show wave forms of various signals appearing at various parts of the block diagram of FIG. 2.

Reference is now made to FIG. 3, which illustrates a second preferred embodiment of the present invention. In the following, the same parts as those of FIG. 1 will not be referred to in detail for brevity. An amplifier 27 receives the signal from the detector 5 to amplify the same to a predetermined level. The amplified signal is then fed to a wave form shaping circuitry 28 to be shaped as shown in FIG. 4B. The signal from the shaping circuitry 28 is then fed to an AND gate 29 through an input terminal 29*a*. The AND gate receives the signal from the switching means 13 at an input terminal 29*b*. The output terminal (no numeral) of the AND gate 29 is connected to an integrator 30 which integrates the magnitudes of the pulses from the circuitry 28. As shown, the reset signal generator 26 is interposed between the switching means 13 and the integrator 30, resetting the integrator 30 just as already referred to in connection with FIG. 1. The signal from the integrator 30 is then fed to the next stage, viz, a comparator 31 which compares the magnitude of the supplied signal with that of a reference signal to generate a signal indicative of a logic "1" if the former is less than the latter. The comparator 31 is connected to an AND gate 32 through an input terminal 32*a*. On the other hand, a switching means 13', which is similar to the switching means 13, is connected to the AND gate 32 through an input terminal 32*b*, supplying the same with a signal indicative of a logic "1" at the end of the time period of the signal from the switching means 13. The output terminal (no numeral) of the AND gate 32 is connected to the relay circuit 24.

In the following, the operation of the second preferred embodiment of FIG. 3 will be described in connection with FIGS. 4A–4G. If the weft yarn 3 separates from one of the electrodes 1 and 2, two times, for example, while the signal from the switching means 13 (FIG. 4C) indicates a logic "1," then the signal from the detector 5 has a wave form as shown in FIG. 4A. The signal from the detector 5 is fed to the amplifier 27 to be amplified thereat to a predetermined level. The signal (not shown) from the amplifier 27 is fed to the shaping circuitry 28 from which the signal having a wave form as shown in FIG. 4B is generated to be fed to the AND gate 29 through the input terminal 29*a*. Therefore, the AND gate 29 generates a signal with a wave form as shown in FIG. 4D, which signal is then fed to the integrator 30 to be integrated therein. The wave form of the output of the integrator 30 is shown in FIG. 4E. The signal from the integrator 30 is then fed to the comparator 31 which compares the magnitude of the supplied signal with that of the reference signal ("L" in FIG. 4E), wherein, when the latter is more than the former, the signal from the comparator 32 indicates a logic "1," on the other hand, otherwise, the signal from the comparator 32 indicates a logic "0," as shown in FIG. 4F. Whilst, the AND gate 32 receives a signal indicative of a logic "1" at the end of the time period of the signal from the switching means 13 as shown in FIG. 4G. Therefore, in the above case, the AND gate 32 does not generate a control signal which is to be fed to the relay circuit 24 to open the switch 16.

It is understood that, if the magnitude of the signal from the integrator 30 does not exceed the reference level "L", the AND gate 32 generates the signal indicative of a logic "1" therefrom to open the switch 16 to deenergize the weaving loom.

It is apparent from the foregoing that according to the present invention the defect inherent in the prior art can be removed.

While the invention has been described in connection with two exemplary embodiments thereof, it will be understood that many modifications will be readily apparent to those of ordinary skill in the art; and that this application is intended to cover any adaptation or variations thereof. Therefore, it is manifestly intended that this invention be only limited by the claims and the equivalents thereof.

What is claimed is:

1. A method of controlling a weft inserting motion of a weaving loom for stopping the loom in response to failure in the weft inserting motion, which loom is equipped with detecting means provided at the opposite side with respect to a weft yarn shooting means, and which method comprises the steps of:

monitoring the operation of the loom and producing a train of first signals at time intervals in synchronism with the motion of the loom, each of the first signals representing a detecting time period for controlling the weft inserting motion;

monitoring picks of a weft shot into a shed of warp yarns and producing a second signal representing whether the weft yarn is detected by the detecting means;

producing a train of third signals at a predetermined time intervals;

storing the third signals only if the first signal coincides with the second signal;

producing a control signal responsive to a predetermined number of the third signals stored within the detecting time period to stop the loom; and clearing the stored third signals at the end of the detecting time period.

2. A method of controlling a weft inserting motion of a weaving loom for stopping the loom in response to failure in the weft inserting motion, which loom is equipped with detecting means provided at the opposite side with respect to a weft yarn shooting means, and which method comprises the steps of:

monitoring the operation of the loom and producing a train of first signals at time intervals in synchronism with the motion of the loom, each of the first signals representing a detecting time period for controlling the weft inserting motion;

monitoring picks of a weft yarn shot into a shed of warp yarns and producing a second signal representing whether the weft yarn is detected by the detecting means;

adding the second signals in their magnitude only if the second signals coincides with the first signal;

producing a control signal responsive to a predetermined magnitude of the second signals added within the detecting time period to stop the loom; and clearing the added second signals at the end of the detecting time period.

3. A method as claimed in claim 2, further comprising, monitoring the operation of the loom and producing a train of third signals at the end of each of the first signals, and wherein said control signal is produced only if the control signal coincides with the third signal.

4. A device for controlling a weft inserting motion of a weaving loom for stopping the loom in response to failure in the weft inserting motion, which device comprises in combination:

a first monitoring means for monitoring the operation of the loom and producing a train of first signals at time intervals in synchronism with the motion of the loom, each of which first signals represents a detecting time period for controlling the weft inserting motion;

a detecting means for detecting the presence of a weft yarn in a shed of warp yarns;

a second monitoring means for monitoring picks of the weft yarn shot into the shed of the warp yarns, which means is connected to the detecting means and produces a second signal representing whether the weft yarn is detected by the detecting means;

a pulse generator producing a train of third signals at predetermined time intervals;

an AND gate provided with three input terminals connected to said first and said second monitoring means and said pulse generator, respectively, and provided with an output terminal;

a counter connected to the output terminal of said AND gate to count the number of the third signals, generating a control signal in response to a predetermined number of the third signals counted within the detecting time period for stopping the loom; and a reset signal generator connected between said first monitoring means and said counter, clearing the counted number of the third signal at the end of the detecting time period.

5. A device as claimed in claim 4, wherein the detecting means includes two electrodes which are arranged to be electrically connected by the weft yarn shot into the shed.

6. A device as claimed in claim 5, wherein the second monitoring means includes a detecting signal generator connected in series with the detecting means and also connected to the AND gate.

7. A device as claimed in claim 6, wherein the second monitoring means further includes an inverter provided between the detecting signal generator and the AND gate.

8. A device as claimed in claim 7, wherein the second monitoring means further includes a wave form shaping circuitry provided between the detecting signal generator and the inverter.

9. A device for controlling a weft inserting motion of a weaving loom for stopping the loom in response to failure in the weft inserting motion, which device comprises in combination:

a first monitoring means for monitoring the operation of the loom and producing a train of first signals at time intervals in synchronism with the motion of the loom, each of which first signals represents a detecting time period for controlling the weft inserting motion;

a detecting means for detecting a contact of a weft yarn with the same, which weft yarn is shot into a shed of warp yarns;

a second monitoring means for monitoring picks of the weft yarn shot into the shed of the warp yarns, which means is connected to the detecting means and produces a second signal representing whether the weft yarn contacts the detecting means;

an AND gate provided with two input terminals connected to the first and the second monitoring means, respectively, and provided with an output terminal;

an integrator connected to the output terminal of the AND gate to integrate an output of the AND gate;

a comparator connected to the integrator generating a control signal in response to a predetermined magnitude of an output of the integrator for stopping the loom; and a reset signal generator connected between said first monitoring means and the integrator, clearing the integrated output of the AND gate at the end of the detecting time period.

10. A device as claimed in claim 9, wherein the detecting means includes two electrodes which are electrically connected by the weft yarn shot into the shed.

11. A device as claimed in claim 10, wherein the second monitoring means includes a detecting signal generator connected in series with the detecting means and also connected to the AND gate.

12. A device as claimed in claim 11, wherein the second monitoring means further includes a wave form shaping circuitry provided between the detecting signal generator and the AND gate.

13. A device as claimed in claim 9, further comprising, another AND gate provided with two input terminals one of which is connected to an output terminal of the comparator, and a third monitoring means for monitoring the operation of the loom and producing a train of third signals each representing an end of the detecting time period, the third monitoring means being connected to the other input terminal of the another AND gate.

* * * * *